US010875054B2

(12) United States Patent
Kulkarni et al.

(10) Patent No.: US 10,875,054 B2
(45) **Date of Patent: *Dec. 29, 2020**

(54) COATING SYSTEM AND METHOD

(71) Applicant: General Electric Company, Schenectady, NY (US)

(72) Inventors: Ambarish Kulkarni, Niskayuna, NY (US); Byron Pritchard, Niskayuna, NY (US); Shankar Sivaramakrishnan, Schenectady, NY (US); Krzysztof Lesnicki, Niskayuna, NY (US); Hrishikesh Keshavan, Niskayuna, NY (US); Bernard Patrick Bewlay, Niskayuna, NY (US); Mehmet Dede, Cincinnati, OH (US); Larry Rosenzweig, Niskayuna, NY (US); Jay Morgan, Niskayuna, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 49 days.

This patent is subject to a terminal disclaimer.

(21) Appl. No.: 16/280,563

(22) Filed: Feb. 20, 2019

(65) Prior Publication Data

US 2019/0184423 A1 Jun. 20, 2019

Related U.S. Application Data

(62) Division of application No. 15/368,242, filed on Dec. 2, 2016, now Pat. No. 10,265,725.

(51) Int. Cl.
*B05D 5/00* (2006.01)
*F01D 5/00* (2006.01)
(Continued)

(52) U.S. Cl.
CPC ..... *B05D 5/005* (2013.01); *B05B 7/025* (2013.01); *B05B 7/067* (2013.01); *B05B 7/068* (2013.01);
(Continued)

(58) Field of Classification Search
CPC ..... B05B 7/025; B05B 7/067; B05B 7/068; B05B 7/10; B05B 7/1431; B05B 7/1481;
(Continued)

(56) References Cited

U.S. PATENT DOCUMENTS 3,635,401 A * 1/1972 Bromley ..... B05B 5/03 239/705
2006/0045985 A1* 3/2006 Kozak ..... H01M 8/0245 427/458

(Continued)

*Primary Examiner* — Alexander M Weddle
(74) *Attorney, Agent, or Firm* — Christopher R. Carroll; The Small Patent Law Group LLC

(57) ABSTRACT

Systems and methods that provide or restore a coating to a component are provided. The systems and methods utilized an atomizing spray device. A gas and a slurry that comprises fluid and ceramic particles are supplied to the atomizing spray device. The slurry and gas are discharged from the spray device to form two-phase droplets. The fluid within the droplets evaporates to prevent the fluid from becoming part of the coating as the droplets traverse through the air and prior to impacting the surface of the component.

20 Claims, 7 Drawing Sheets

(51) Int. Cl.

| | |
|---|---|
| ***F01D 5/28*** | (2006.01) |
| ***C23C 24/08*** | (2006.01) |
| ***B05B 7/02*** | (2006.01) |
| ***B05B 7/06*** | (2006.01) |
| ***B05B 7/10*** | (2006.01) |
| ***B05B 7/14*** | (2006.01) |
| *B05B 7/16* | (2006.01) |

(52) U.S. Cl.
CPC ..... *B05B 7/10* (2013.01); *B05B 7/1481* (2013.01); *C23C 24/08* (2013.01); *F01D 5/00* (2013.01); *F01D 5/288* (2013.01); *B05B 7/1431* (2013.01); *B05B 7/166* (2013.01); *F05D 2230/312* (2013.01); *F05D 2230/90* (2013.01)

(58) Field of Classification Search
CPC ..... B05B 7/166; B05D 5/005; C23C 24/08; F01D 5/00; F01D 5/288; F05D 2230/312; F05D 2230/90
See application file for complete search history.

(56) References Cited

U.S. PATENT DOCUMENTS

| | | | | |
|---|---|---|---|---|
| 2012/0009080 | A1* | 1/2012 | Shaw | C22C 32/0089 419/38 |
| 2015/0321964 | A1* | 11/2015 | Sun | C23C 4/18 428/143 |
| 2020/0164392 | A1* | 5/2020 | Bewlay | B05B 7/1686 |

* cited by examiner

COATING SYSTEM AND METHOD

CROSS-REFERENCE TO RELATED APPLICATIONS

This application is a divisional of U.S. patent application Ser. No. 15/368,242, which was filed on 2 Dec. 2016, and the entire disclosure of which is incorporated herein by reference.

FIELD

The subject matter described herein relates to systems that apply material to surfaces to apply and/or repair coatings on the surfaces, such as thermal barrier coatings (TBC).

BACKGROUND

Atomizing spray devices are utilized in many different applications to apply coatings onto machinery. In one example, coatings are used in turbine engines such as aircraft engines and industrial gas turbines to provide a thermal barrier within the turbines. Over time, these thermal barrier coatings degrade as a result of spallation and damage (e.g., exposure to exhaust heat, which wears the coating down). As the thermal barrier degrades, the turbine is more susceptible to failures and the coating may need to be restored. Typically, the thermal barrier coating is restored by disassembly of the turbine engine so that a restorative thermal barrier coating can be applied. This is problematic where the engine is being utilized as the amount of downtime required for disassembly greatly impacts costs and efficiencies of operating the engine (or systems that rely on operation of the engine).

While in this example, a thermal barrier coating is applied to a turbine engine, atomizing spray devices are similarly utilized in other coating applications including restoration of nozzles, blades and the like. Additionally, atomizing spray devices are utilized for preventative coatings such as mid-seal coatings and other such coatings.

BRIEF DESCRIPTION

In one embodiment, a system is provided. The system has a fluid reservoir containing a fluid that promotes evaporation when the fluid is exposed to gas and a spray device having one or more hollow chambers having one or more conduits disposed therethrough that are fluidly connected to the first reservoir to receive a slurry containing the fluid and a mix of ceramic particles and the gas. Said one or more conduits extend from a conduit inlet to a conduit outlet where the slurry is discharged to form droplets containing the fluid such that, based on a discharged amount of fluid in the droplets, the fluid promotes evaporation when the fluid is exposed to a gas, as the droplets traverse from the spray device toward an article.

In one embodiment, a method of providing a coating to a component is provided. This method includes providing a spray device and supplying a slurry comprising fluid and ceramic particles to the spray device. The slurry is discharged from the spray device to form droplets containing the fluid to impact the component. As the droplets travel from the spray device towards the component the fluid contained in the droplets evaporates prior to impacting the component.

In one embodiment, a spray device is provided. The spray device has a housing and a hollow chamber disposed through the housing from a chamber inlet to a chamber outlet. The hollow chamber has a conical shape adjacent the chamber outlet that tapers outwardly away from a center axis of the hollow chamber and toward the chamber outlet such that a gas flowing through the hollow chamber is directed away from the center axis of the hollow chamber upon being discharged from the chamber outlet. A conduit is disposed through and centrally located within the hollow chamber from a conduit inlet to a conduit outlet and receiving a slurry. The conduit has a conical shape adjacent the conduit outlet that tapers outwardly away from the center axis of the hollow chamber and toward the conduit outlet such that the slurry flowing through the conduit is directed away from the center axis of the hollow chamber upon being discharged from the conduit outlet. One or more target surfaces are disposed in the chamber outlet and secured to the conduit such that an edge of the one or more target surfaces atomize the gas and slurry flowing past the edge to provide a uniform coating of a slurry and gas droplet formed by the spray device onto a surface of a component.

In one embodiment, a method of providing a coating to an article is provided and includes supplying a slurry comprising fluid and ceramic particles to a spray device and discharging the slurry from the spray device to form droplets containing the fluid and the ceramic particles that are directed toward the component. As the droplets traverse from the spray device toward the component the fluid contained in the droplets at least partially evaporates prior to the ceramic particles impacting the component.

DETAILED DESCRIPTION

Figure 1:
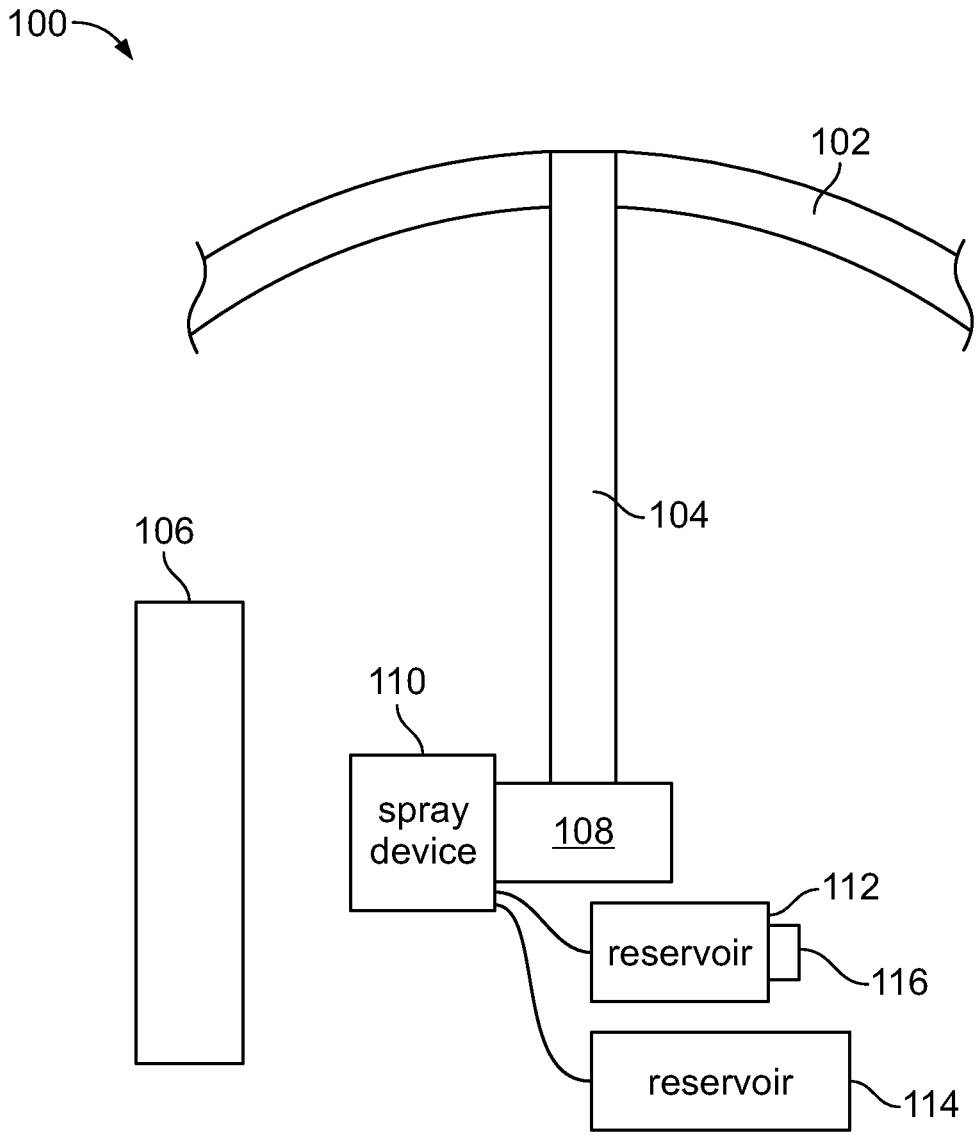
FIG. 1 is a schematic diagram of a coating system.

Provided is a system utilized to coat a component with an atomizing spray device. In one embodiment, a coating restoration system includes a 360-degree rail and glider where the glider has an attachment tool to methodically move the glider to locate the glider anywhere in relation to a component such as a turbine. In this manner, an atomizing spray device attached to the glider is able to apply a coating on all surfaces of the component and at any given angle without the need of removing the component from existing machinery or disassembling the component. The process includes the selecting the nozzle spray angle, the spray rates, the spray duration, the glider travel speeds during spraying, the number of passes over the targeted liner surface, and/or the suitability of a liner for coating based on the condition of the thermal barrier coating.

According to the method of coating the component, two fluid streams (typically one liquid and one gas) are introduced into a device through fluid inlets of the device to combine at fluid outlets and to form droplets that comprise a slurry of ceramic particles in a gas. Thus, the droplets are two-phase droplets of ceramic particles within the fluid. In particular, the first fluid stream is a slurry that includes a first fluid such as alcohol or water and the ceramic particle that is to be deposited on the component. The second fluid is typically a gas such as air, nitrogen or argon that mixes with the slurry and forms the shape of the spray resulting from the plurality of droplets formed from the slurry and gas discharged from the spray device.

The first fluid is selected to promote evaporation of the fluid as the two-phase droplets traverse through the air before the droplets impact the surface of a component. A fluid is considered to be selected to promote evaporation when the kinetic energy required to transform a given volume of the fluid from liquid to gas is less than the kinetic energy required to transform the same volume of water into water vapor. Additionally, evaporation is promoted by increasing the amount of evaporation compared to if that step was not taken. Thus, promoting evaporation can encompass partial evaporation of a fluid, complete evaporation of a fluid, or when partial evaporation of a fluid occurs during a time when the fluid is traversing through the air and finishes complete evaporation upon contacting a surface. Similarly, the temperature of the first fluid is selected or increased to again promote evaporation of the fluid after the fluid is discharged from the spray device but before impacting a component. Thus, either the first fluid is eliminated from the coating as a result of complete evaporation of the fluid prior to droplet impact or the amount of fluid impacting the component is substantially reduced. The amount of fluid remaining in the droplet impacting the component is considered substantially reduced when more than 50% of the fluid by weight of the fluid discharged by the spray device evaporates before impacting the component. By eliminating or minimizing fluid in the droplets a dry coating is provided that improves adhesion, fine atomization and uniformity of the coating layer. This also eliminates or minimizes cracking and imperfections within the coating after the application of the coating. Such imperfections occur because of the evaporation of the first fluid within the coating after application and bubbling cause by the fluids. The end result is a coating that is both uniform and less susceptible to wear and degradation during the life of the coating.

The atomizing spray devices disclosed in the figures are examples of spray devices that are utilized to accomplish the method of applying a coating to a component. Each individual spray device has advantages and results in different distributions of spray and coatings to occur at the surface of the component to be coated. Thus, a user of the coating restoration system may select the spray device depending on the component and the desired coating that is desired by an end user. Additional spray devices can be provided that have elements or features of the disclosed spray devices, are a combination of the spray devices disclosed or provide components and elements not described as part of the disclosed spray devices yet still function to apply a coating to a component utilizing the method taught herein.

In some embodiments of the atomizing spray device a device referred to as a pintle is utilized. A pintle generally is one or more target surfaces or areas utilized to atomize a gas, fluid and/or slurry moving past the surfaces. The pintle has a converging shape that narrows, tapers, is conical or otherwise reducing in size.

FIG. 1 is a schematic diagram of one embodiment of a coating system 100. The coating system 100 may be used as a coating restoration system that restores (e.g., repairs, replenishes, augments, etc.) an existing or previously applied coating on a surface, or may be used to initially apply or otherwise deposit a coating onto the surface. The system 100 includes a rail element 102 and glider element 104 that function to allow 360 degrees of movement in comparison to a component 106 that needs to be restored or coated. The rail element 102 is an elongated body on which the glider element 104 moves along to coat or restore a coating on different locations of the component 106. The rail element 102 may be placed inside the component 106 to allow the coating to be applied onto interior surfaces of the component 106. The component 106 can be any mechanical component including but not limited to a combustor, a turbine, a nozzle, a blade or the like. The component 106 can also be part of any machinery including, but not limited to a commercial airliner or the like.

An attachment 108 is provided on the glider element 104 to receive a spray device 110, that in one embodiment is an atomizing spray device, to provide the coating for the component 106. In one embodiment, the coating is utilized to restore a thermal barrier coating of the component 106. The spray device 110 receives fluid from one or more reservoirs 112, 114 via one or more pumps (not shown) to provide a slurry that includes the fluid and ceramic particles into the spray device 110 that is atomized and discharged by the spray device 110 to form droplets that impact the component 106 to form the coating. While described as fluid and ceramic particles in this embodiment and other embodiments, in this and other embodiments the fluid can be water and the ceramic particles can be any solid particles that function to form a coating.

In one embodiment, a first or fluid reservoir 112 contains a fluid such as water, alcohol, or the like. The fluid of the first reservoir can be selected to promote evaporation of the fluid in the droplet formed by the spray device 110 as the droplet traverses through the air from the spray device 110 before impacting the component 106. In this manner, the fluid is either completely eliminated from the droplet that impacts the component 106 or the amount of fluid remaining in the droplet impacting the component 106 is substantially reduced. The fluid may be a liquid in one or more embodiments, but alternatively may include a gas.

Similarly, the temperature of the fluid in the system 100 can be increased, either by a heating element 116, or other device or method such that when the fluid is finally discharged from the spray device 110 again the amount of fluid remaining in the droplet impacting the component 106 is substantially reduced. Such increase in temperature, or heating, can occur at the fluid reservoir 112, in conduits conveying the fluid to the spray device 110 or within the spray device 110. In one example, both the temperature of the fluid is increased within the system and the fluid is selected to promote evaporation.

The fluid reservoir 112 is also designed to minimize the amount of gas from evaporated fluid that is conveyed to the spray device 110. Specifically, the fluid reservoir can have an outlet adjacent the bottom of the reservoir or can be cooled to prevent gas from evaporated fluid from flowing from the reservoir 112. This ensures that the slurry of fluid and ceramic particles can be created and ensures a minimal amount of fluid evaporates in the system prior to discharging the fluid as part of the slurry from the spray device 110.

In an embodiment, a second or gas reservoir 114 is also provided. The reservoir contains a fluid that typically is a gas and thus is considered a gas reservoir. The gas in the gas reservoir 114 can include air, nitrogen, argon and the like. The gas flows from the gas reservoir 114 to the spray device 110 so the gas can be combined with the slurry by the spray device 110 to form the droplets that coat the component 106.

Figure 3:
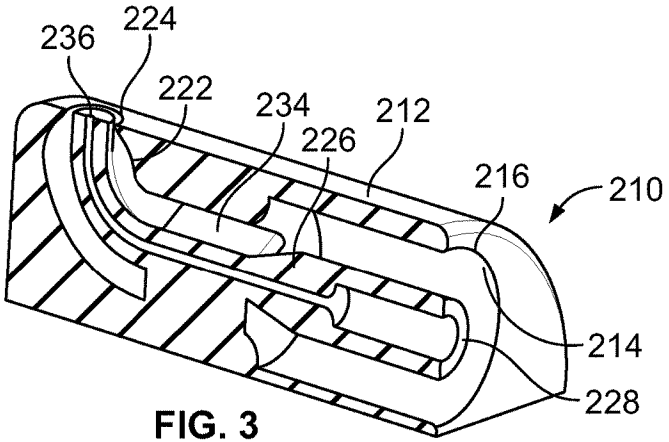
FIG. 3 is a sectional view of the atomizing spray device of FIG. 2 taken along the line 3-3 shown in FIG. 2.
Figure 2:
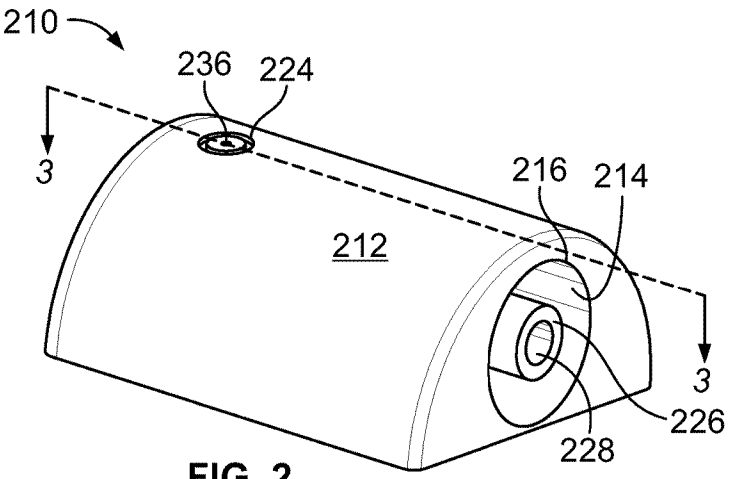
FIG. 2 is a perspective view of an atomizing spray device in accordance with one embodiment.
Figure 4:
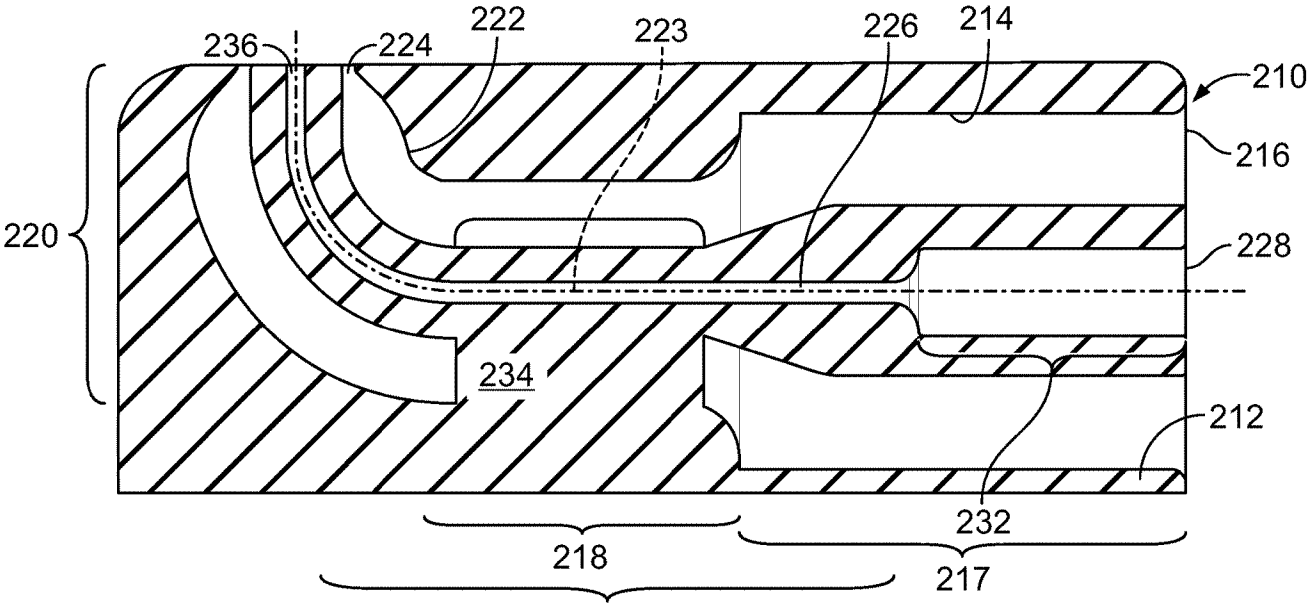
FIG. 4 is a cut away plan view of the atomizing spray device of FIG. 2.

FIGS. 2 through 16 all show examples of an atomizing spray device 110. Other examples and embodiments of the atomizing spray devices 110 can be provided without falling outside of this disclosure. FIGS. 2 through 4 show a first atomizing spray device 210 that can be utilized within a coating restoration system. The spray device 210 has a housing 212 having a hollow chamber 214 disposed therethrough. The hollow chamber 214 extends through the housing 212 from a chamber inlet 216 through a first chamber section 217 that has a first diameter and narrows to a second chamber section 218 that has a diameter that is less than the diameter of the first chamber section 217 to cause fluid therein to increase in speed through the second chamber section 218. The second chamber section 218 extends into a third chamber section 220 that arcuately extends from the second chamber section 218 toward an outer wall of the housing 212. The third chamber section 218 has an outer diameter 222 that curves outwardly and then inwardly toward a center axis 223 of the hollow chamber 214. This shape provides a conical shaped section that converges toward and terminates in an annular outlet 224. The curvature of the outer diameter 222 of the third chamber section 218 determines the angle at which fluid flowing through the hollow chamber exits the annular outlet 224 and toward a center axis 223 of the hollow chamber 214.

A conduit 226 is disposed through the hollow chamber 214 and is centrally located within the hollow chamber 214 along the center axis 223 of the hollow chamber 214. The conduit 226 extends through the hollow chamber 214 from a conduit inlet 228 through a first conduit section 230 that has a first diameter and narrows to a second conduit section 232 that has a diameter that is less than the diameter of the first conduit section 230 to cause fluid therein to increase in speed through the second conduit section 232. Rib elements 234 are disposed within the hollow chamber 214 and engage the conduit 226 to support the conduit 226 within the hollow chamber 214 while allowing fluid flow through the hollow chamber 214. The second conduit section 232 extends arcuately through the third chamber section 218 toward the outer wall of the housing to a conduit outlet 236 continuing to extend along the center axis 223 of the chamber 214. The conduit outlet 236 is centrally located within the annular outlet 224 of the hollow chamber 214 such that the fluid flowing from the annular outlet 224 is angled toward the fluid flowing through the conduit outlet 236 to control the diameter of the resulting spray flowing through the conduit outlet 236.

During operation of the spray device 210 of this embodiment, a first fluid such as air, nitrogen, argon or the like is pumped into the chamber inlet 216 by a pump (not shown) while a second fluid, such as alcohol or water, contains ceramic particles therein to form a slurry and is pumped by a pump (not shown) through the conduit 226. The first fluid flows through the sections of the hollow chamber 214 and is angled by the curve of the outer diameter of the third chamber section 218 to form an air jet directed toward the slurry that flows through the conduit outlet 236. When discharged the first fluid and slurry combine to form two-phase droplets. As the droplets traverse toward the surface of the component the second fluid evaporates leaving only the ceramic particles to provide a uniform coating of the surface of the component. The resulting spray on the surface of the component is a circular spray having a Gaussian distribution at the surface of the component.

Figure 6:
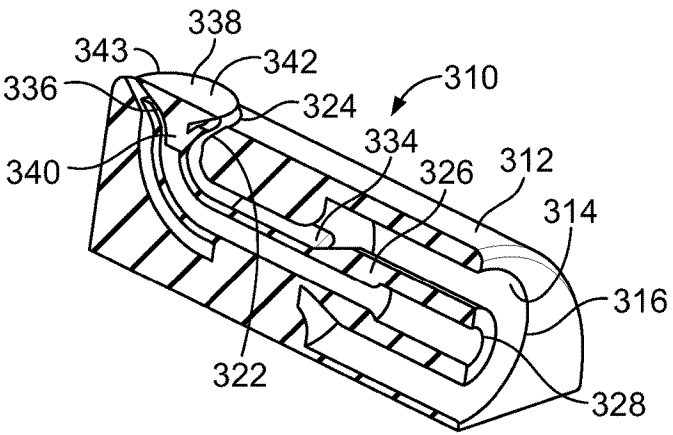
FIG. 6 is a sectional view of the atomizing spray device of FIG. 5 taken along the line 6-6 shown in FIG. 5.
Figure 5:
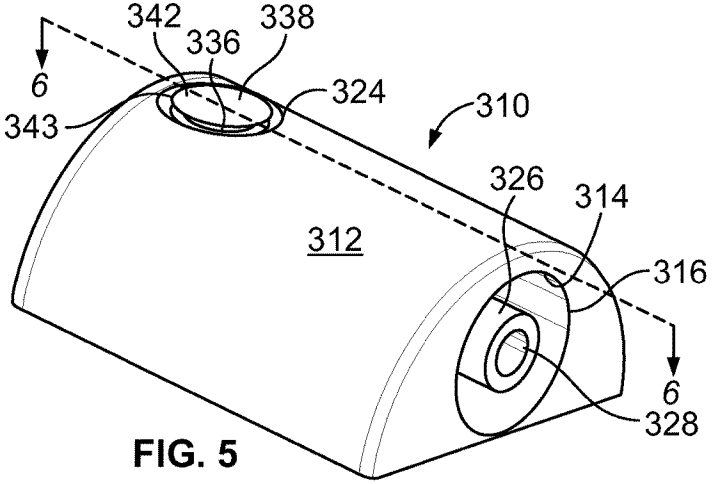
FIG. 5 is a perspective view of an atomizing spray device in accordance with one embodiment.
Figure 7:
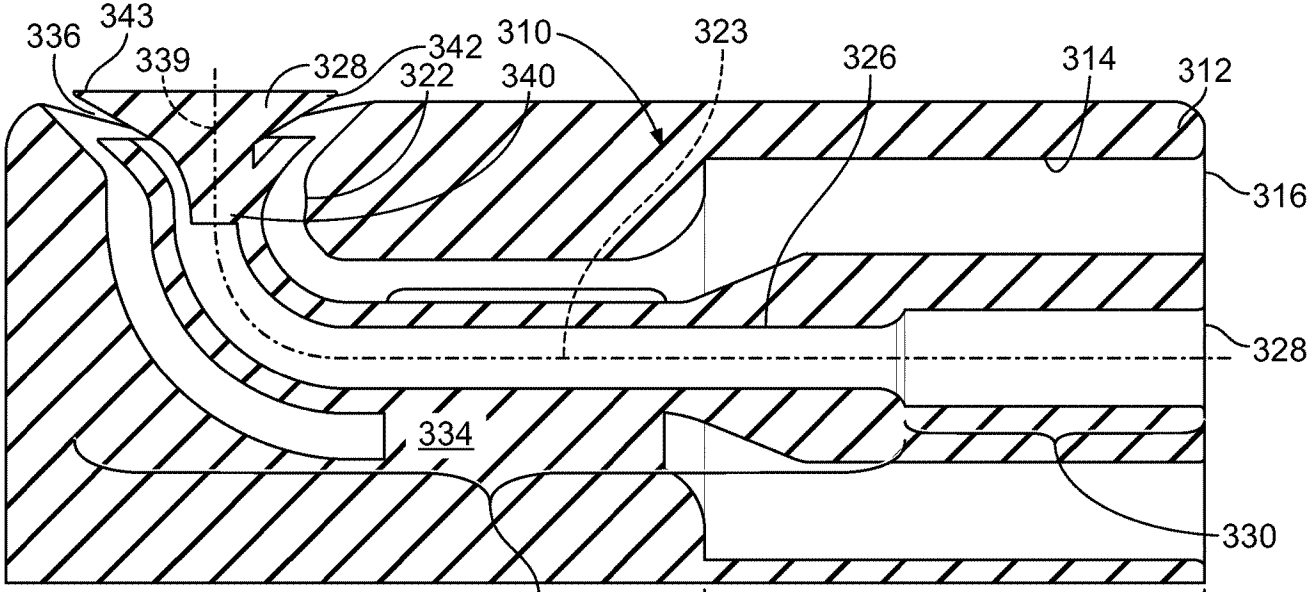
FIG. 7 is a cut away plan view of the atomizing spray device of FIG. 5.

FIGS. 5 through 7 show another embodiment of an atomizing spray device 310 that can be utilized within a coating restoration system. The spray device 310 has a housing 312 having a hollow chamber 314 disposed therethrough. The hollow chamber 314 extends through the housing 312 from a chamber inlet 316 through a first chamber section 317 that has a first diameter and narrows to a second chamber section 318 that has a diameter that is less than the diameter of the first chamber section to cause fluid therein to increase in speed through the second chamber section 318. The second chamber section 318 extends into a third chamber section 320 that arcuately extends from the second chamber section 318 toward an outer wall of the housing 312. The third chamber section 318 has an outer diameter 322 that curves outwardly away from a center axis 323 of the chamber 314 to provide a conical shaped section that terminates in an annular outlet 324. The curvature of the outer diameter 322 of the third chamber section 318 determines the angle at which fluid flowing through the hollow chamber 314 exits the annular outlet 324 and away from a center axis 323 of the chamber 314.

A conduit 326 is disposed through the hollow chamber 314 and is centrally located within the hollow chamber 314. The conduit 326 extends through the hollow chamber 314 from a second or conduit inlet 328 through a first conduit section 330 that has a first diameter and narrows to a second conduit section 332 that has a diameter that is less than the diameter of the first conduit section 330 to cause fluid therein to increase in speed through the second conduit section 332. Rib elements 334 are disposed within the hollow chamber 314 and engage the conduit 326 to support the conduit 326 within the hollow chamber 314 while allowing fluid flow through the hollow chamber 314. The second conduit section 332 extends arcuately through the third chamber section 318 toward the outer wall of the housing to a conduit outlet 336. In this embodiment, at the conduit outlet 336 the second conduit section increases in diameter and extends away from the center axis of the chamber 314 to form a conically shaped outlet 336.

In this embodiment, a pintle 338 is disposed within the outlet 336 and engages the second conduit section 332 within the outlet 336 against a sidewall of the outlet 336 that is extending away from the center axis of the chamber 314. The pintle is secured such that a center axis 339 of the pintle 338 is off set from the center axis 323 of the chamber 314 at the outlet 324. The pintle 338 is conically shaped extending from a smaller diameter first end 340 to a larger diameter second end 342 that has an edge 343 and causes atomization of the slurry off the edge 343 of the larger diameter second end 342.

During operation of the spray device 310 of this embodiment, a first fluid such as air, nitrogen, argon or the like is pumped into the chamber inlet 316 by a pump (not shown) while a second fluid, such as alcohol or water, contains ceramic particles therein to form a slurry that is pumped by a pump (not shown) through the conduit 326. The first fluid flows through the sections of the hollow chamber 314 and is angled away from the center axis 323 of the chamber 314. The first fluid or gas flows past the edge 343 of the pintle 338 to atomize the gas. Meanwhile, the slurry flows through the conduit outlet 336 also away from the center axis 323 of the chamber 314 and past the edge 343 of the pintle 338 to atomize the slurry. As a result, when gas and slurry are discharged from the spray device, the gas and slurry mix to form two-phase droplets. The first fluid also acts to direct the droplets to form a conically shaped spray thus causing a circular spray pattern with a hollow interior, or a ring shape, at the surface of a component. As the droplets traverse toward the surface of the component, the second fluid within the droplets evaporates leaving only the ceramic particles to provide a uniform, liquid free coat at the surface of the component.

Figure 9:
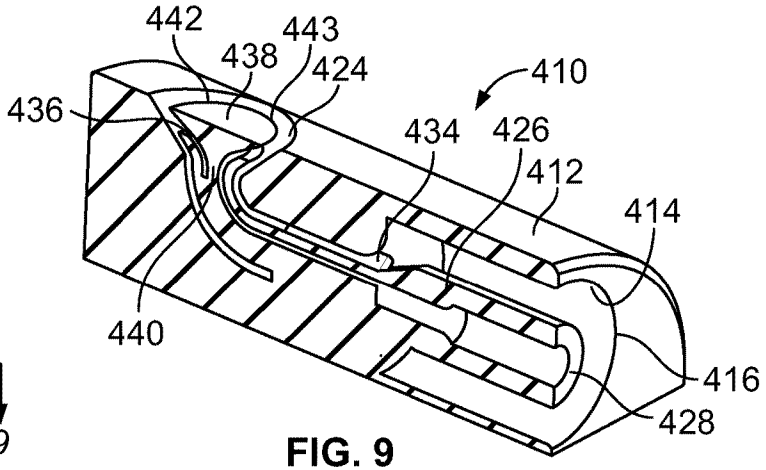
FIG. 9 is a sectional view of the atomizing spray device of FIG. 8 taken along the line 9-9 shown in FIG. 8.
Figure 8:
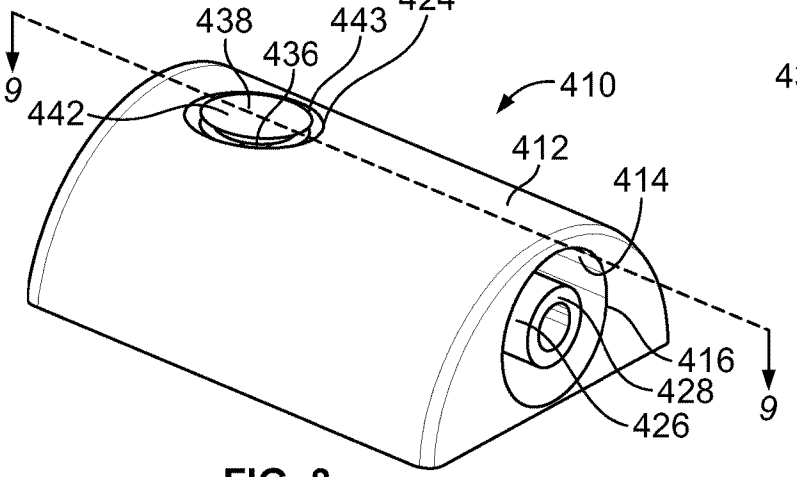
FIG. 8 is a perspective view of an atomizing spray device in accordance with one embodiment.
Figure 10:
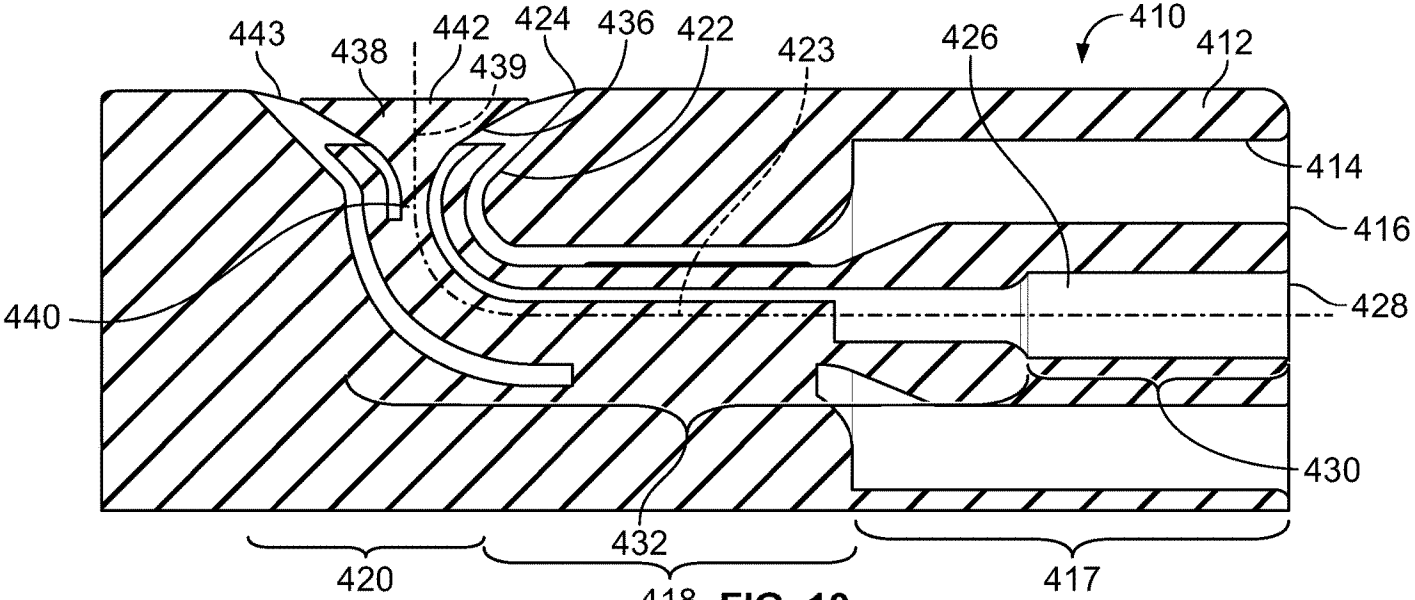
FIG. 10 is a cut away plan view of the atomizing spray device of FIG. 8.

FIGS. 8 through 10 show yet another embodiment of an atomizing spray device 410 that can be utilized within a coating restoration system. The spray device 410 has a housing 412 having a hollow chamber 414 disposed therethrough. The hollow chamber 414 extends through the housing 412 from a chamber inlet 416 through a first chamber section 417 that has a first diameter and narrows to a second chamber section 418 that has a diameter that is less than the diameter of the first chamber section to cause fluid therein to increase in speed through the second chamber section 418. The second chamber section 418 extends into a third chamber section 420 that arcuately extends from the second chamber 418 toward an outer wall of the housing 412. The third chamber section 418 has an outer diameter 422 that curves outwardly away from a center axis 423 of the chamber 414 to provide a conical shaped section that terminates in an annular outlet 424. The curvature of the outer diameter 422 of the third chamber section 418 determines the angle at which fluid flowing through the hollow chamber exits the annular outlet 424 and away from the center axis 423 of the chamber 414.

A conduit 426 is disposed through the hollow chamber 414 and is centrally located within the hollow chamber 414. The conduit 426 extends through the hollow chamber 414 from a conduit inlet 428 through a first conduit section 430 that has a first diameter and narrows to a second conduit section 432 that has a diameter that is less than the diameter of the first conduit section 430 to cause fluid therein to increase in speed through the second conduit section 432. Rib elements 434 are disposed within the hollow chamber 414 and engage the conduit 426 to support the conduit 426 within the hollow chamber 414 while allowing fluid flow through the hollow chamber 414. The second conduit section 432 extends arcuately through the third chamber section 418 toward the outer wall of the housing to a conduit outlet 436. In this embodiment, at the conduit outlet 436 the second conduit section increases in diameter and extends away from the center axis 423 of the third chamber 414 to form a conically shaped outlet 436.

In this embodiment, a pintle 438 is provided similar to the embodiment of FIGS. 5 through 7. In this embodiment the pintle 438 again is disposed within and engages the second conduit section 432. However, in this embodiment the pintle 438 does not engage the outlet 436. As a result, the first end 440 of the pintle 438 having a smaller diameter extends along the center axis 423 of the chamber 414 adjacent the conduit outlet 436 such that the center axis 439 of the pintle 438 aligns with and is the same as the center axis 423 of the hollow chamber 414 at the outlet 436. The pintle 438 again is conically shaped extending from the smaller diameter first end 440 to a larger diameter second end 442 with atomization of the slurry occurring at the edge 443 of the larger diameter end 442. The pintle 438 extends to its second end 442 in such a way to provide even spacing between the pintle 438 to the conduit outlet 436 around the entire conduit outlet 436. The pintle 438 is this embodiment is fully within the housing 412 and allows for an annular slurry flow as a result of being aligned with the center axis 423 of the chamber 414.

During operation of the spray device 410 of this embodiment, a first fluid such as air, nitrogen, argon or the like is pumped into the chamber inlet 416 by a pump (not shown) while a second fluid, such as alcohol or water, contains ceramic particles therein to form a slurry that is pumped by a pump (not shown) through the conduit 426. The first fluid flows through the sections of the hollow chamber 414 and is angled away from the center axis 423 of the hollow chamber 414. The slurry through the conduit outlet 436 also away from the center axis 423 of the hollow chamber 414 and around the pintle 438. As a result, when the first fluid and slurry are discharged from the spray device 410, the fluid and slurry mix to form two-phase droplets. The first fluid directs the droplets to provide a conically shaped spray of the droplet. Thus, a circular spray pattern with a hollow interior, or a ring shape, occurs at the surface of a component. As the droplets traverse toward the surface of a component the liquid in the droplets evaporate leaving only the ceramic particles to coat the surface of the component to provide a uniform coating.

Figure 12:
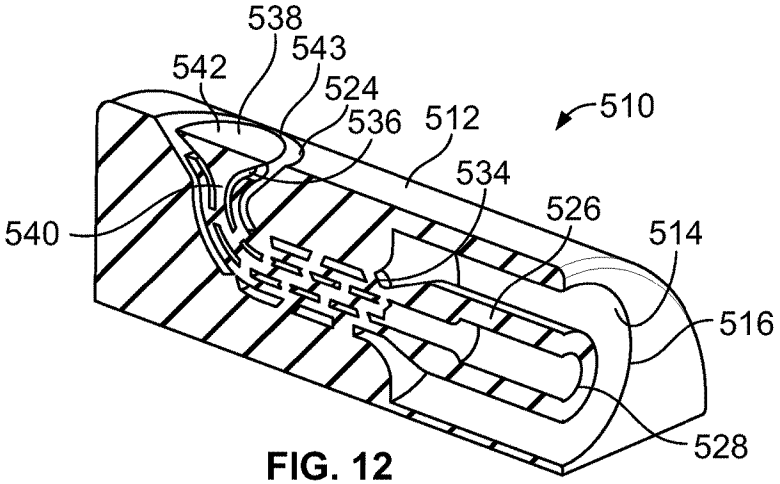
FIG. 12 is a sectional view of the atomizing spray device of FIG. 11 taken along the line 12-12 shown in FIG. 11.
Figure 11:
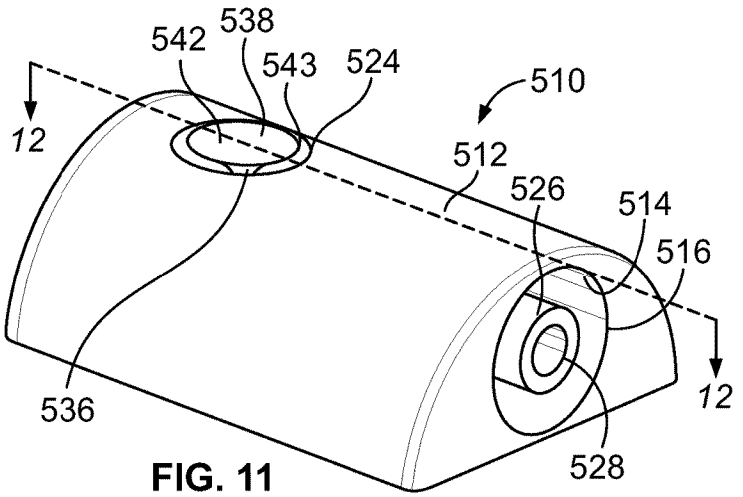
FIG. 11 is a perspective view of an atomizing spray device in accordance with one embodiment.
Figure 13:
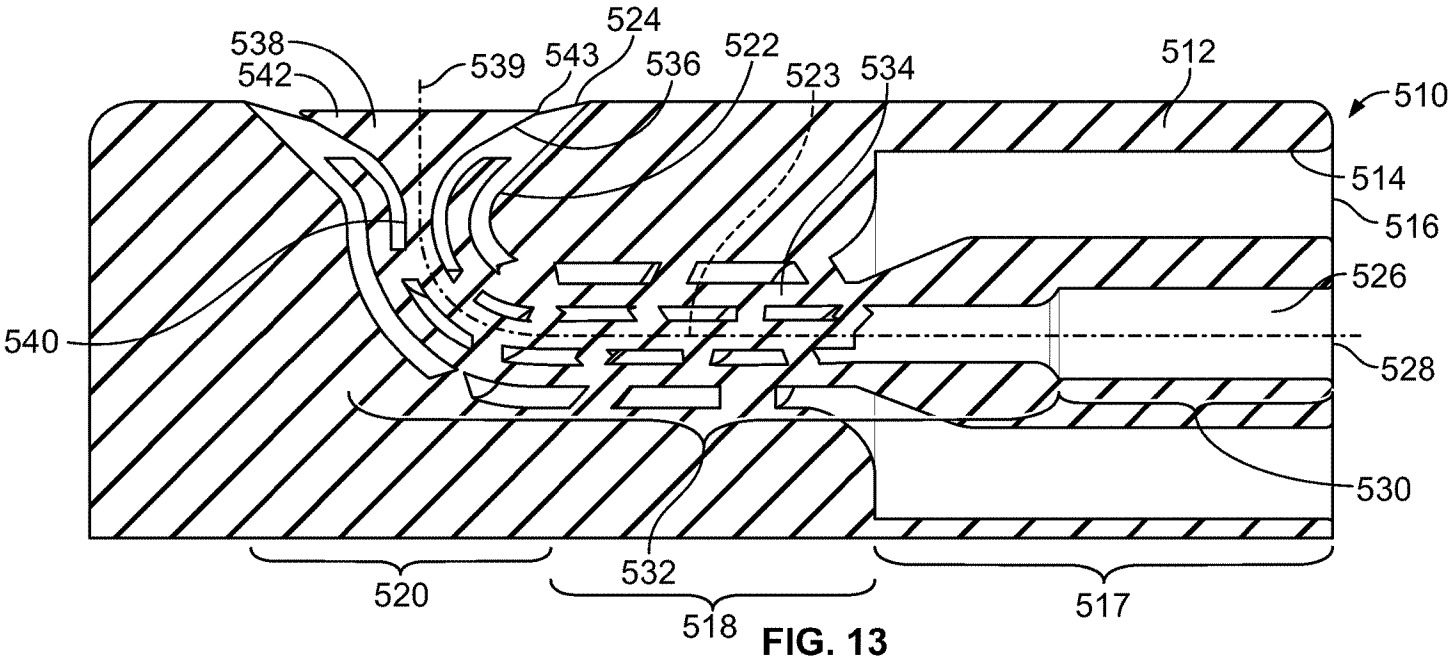
FIG. 13 is a cut away plan view of the atomizing spray device of FIG. 11.

FIGS. 11 through 13 show yet another embodiment of an atomizing spray device 510 that can be utilized within a coating restoration system. The spray device 510 has a housing 512 having a hollow chamber 514 disposed therethrough. The hollow chamber 514 extends through the housing 512 from a chamber inlet 516 through a first chamber section 517 that has a first diameter and narrows to a second chamber section 518 that has a diameter that is less than the diameter of the first chamber section to cause fluid therein to increase in speed through the second chamber section 518. In this embodiment, the second chamber section 518 is helically shaped or curves about a center axis 523 of the chamber 514. The second chamber section 518 extends in this manner into a third chamber section 520 that arcuately extends from the second chamber 518 toward an outer wall of the housing 512. The third chamber section 518 has an outer diameter 522 that curves outwardly away from the center axis 523 of the chamber 514 to provide a conical shaped section that terminates in an annular outlet 524. The curvature of the outer diameter 522 of the third chamber section 518 determines the angle at which fluid flowing through the hollow chamber exits the annular outlet 524 and away from the center axis 523 of the chamber 514.

A conduit 526 is disposed through the hollow chamber 514 and is centrally located within the hollow chamber 514. The conduit 526 extends through the hollow chamber 514 from a conduit inlet 528 through a first conduit section 530 that has a first diameter and narrows to a second conduit section 532 that has a diameter that is less than the diameter of the first conduit section 530 to cause fluid therein to increase in speed through the second conduit section 532. Similar to the second chamber section 518, the second conduit section 532 is helically shaped or curves about a center axis 523 of the hollow chamber 514. Rib elements 534 are disposed within the hollow chamber 514 and engage the conduit 526 to support the conduit 526 within the hollow chamber 514 while allowing fluid flow through the hollow chamber 514. The second conduit section 532 extends arcuately through the third chamber section 518 toward the outer wall of the housing to a conduit outlet 536. In this embodiment, at the conduit outlet 536 the second conduit section increases in diameter and extends away from the center axis 523 of the chamber 514 to form a conically shaped outlet 536.

In this embodiment, a pintle 538 is provided similar to the embodiment of FIGS. 8 through 10. In this embodiment, the pintle 538 is disposed within and engages the second conduit section 532, but does not engage the outlet 536. As a result, the first end 540 of the pintle 538 having a smaller diameter extends along the center axis 523 of the chamber 518 adjacent the conduit outlet 536. In this manner the center axis 539 of the pintle 538 aligns or is the same as the center axis 523 of the chamber 514 at the outlet 524. The pintle 538 again is conically shaped extending from the smaller diameter first end 540 to a larger diameter second end 542 with atomization of the slurry occurring at the edge 543 of the larger diameter end 542. The pintle 538 extends to its second end 542 in such a way to provide even spacing between the pintle 538 to the conduit outlet 536 around the entire conduit outlet 536. The pintle 538 is this embodiment is fully within the housing 512 and allows for an annular slurry flow as a result of being aligned with the center axis 523 of the chamber 514.

During operation of the spray device of this embodiment, a first fluid such as air, nitrogen, argon or the like is pumped into the chamber inlet 516 by a pump (not shown) while a second fluid, such as alcohol or water, contains ceramic particles therein to form a slurry that is pumped by a pump (not shown) through the conduit 526. In this embodiment, the pressurization of the fluid should be increased to address loss in speed as a result of the helix shaped chamber 514 and conduit 526. As the first fluid flows through the second chamber section 518 and flows through the helically shaped section to cause increase sheer over the pintle 538 thus providing a finer, more efficient atomization and finer film of gas resulting passing the pintle 538. Similarly, as the slurry flows through the second conduit section 532 and through the helically shaped section, sheer at the pintle 538 is increased providing a finer, more efficient atomization and finer film of slurry passing the pintle 538.

Similar to the embodiment of FIGS. 8 through 10, the first fluid at the third chamber section 518 is angled away from the center axis 523 of the chamber 514. At this time, the slurry flows through the conduit outlet 536 also away from the center axis 523 of the chamber 514 and around the pintle 538. As a result, the first fluid and slurry mix after being discharged from the spray device 510 to form two phase droplets that traverse toward a component surface. The first fluid directs the droplets to provide a conically shaped spray of the droplets causing a circular spray pattern with a hollow interior, or a ring shape, at the surface of a component. As the droplets flow toward the surface of the component, the liquid in the droplets evaporates leaving only the ceramic particles to provide a uniform coat at the surface of the component. The spray distributions at the surface of the component for each of the embodiments shown in FIGS. 3-5 provide dual peaks, with a peak distribution at an outer perimeter and then a second peak at the inner perimeter of the coating.

Figure 15:
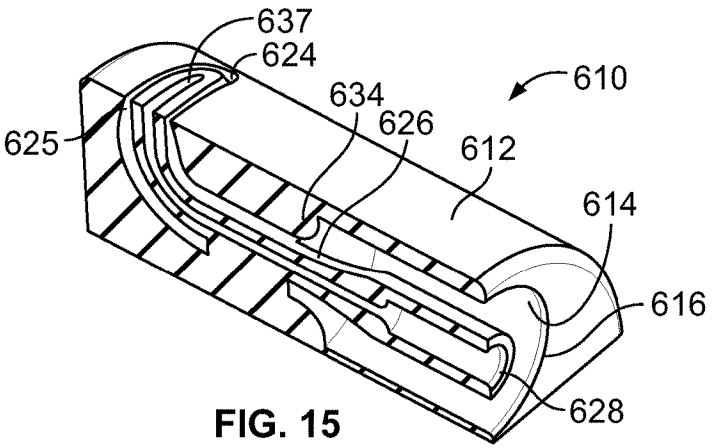
FIG. 15 is a sectional view of the atomizing spray device of FIG. 14 taken along the line 15-15 shown in FIG. 14.
Figure 14:
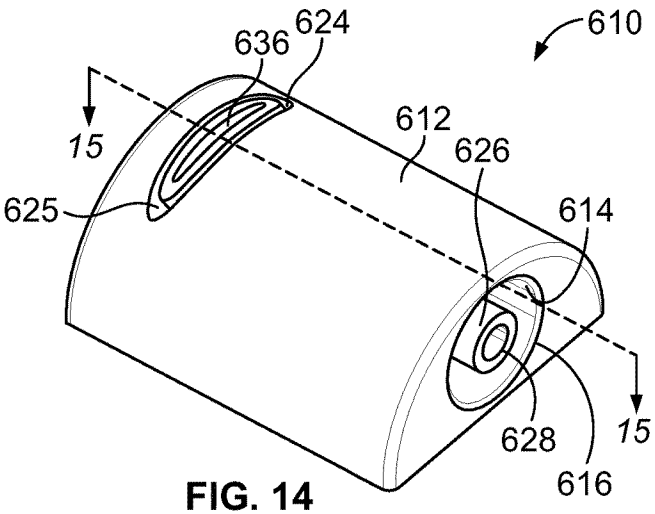
FIG. 14 is a prospective view of an atomizing spray device in accordance with one embodiment.
Figure 16:
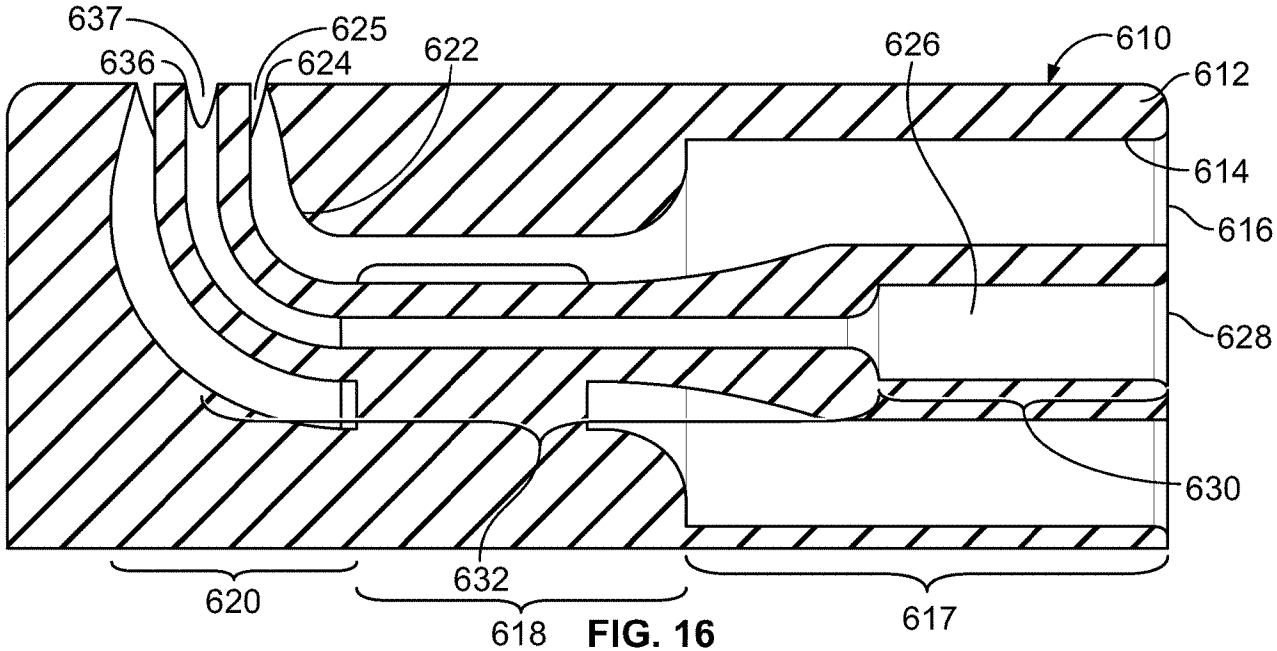
FIG. 16 is a cut away plan view of the atomizing spray device of FIG. 14.

FIGS. 14 through 16 show a final example of an atomizing spray device 610 that can be utilized within a coating restoration system. The spray device 610 has a housing 612 having a hollow chamber 614 disposed therethrough. The hollow chamber 614 extends through the housing 612 from a chamber inlet 616 through a first chamber section 617 that has a first diameter and narrows to a second chamber section 618 that has a diameter that is less than the diameter of the first chamber section to cause fluid therein to increase in speed through the second chamber section 618. The second chamber section 618 extends into a third chamber section 620 that arcuately extends from the second chamber 618 toward an outer wall of the housing 612. The third chamber section 618 has an outer diameter 622 that curves inwardly toward a center axis 623 of the chamber 614 and terminates at an outlet 624 that has an angled surface 625 to form an oval shape outlet 624 in the outer wall of the housing 612.

A conduit 626 is disposed through the hollow chamber 614 and is centrally located within the hollow chamber 614. The conduit 626 extends through the hollow chamber 614 from a conduit inlet 628 through a first conduit section 630 that has a first diameter and narrows to a second conduit section 632 that has a diameter that is less than the diameter of the first conduit section 630 to cause fluid therein to increase in speed through the second conduit section 632. Rib elements 634 are disposed within the hollow chamber 614 and engage the conduit 626 to support the conduit 626 within the hollow chamber 614 while allowing fluid flow through the hollow chamber. The second conduit section 632 extends arcuately through the third chamber section 618 toward the outer wall of the housing to a conduit outlet 636. The conduit outlet 636 has an angled surface 637 similar to the chamber outlet 624 such that the oval shape of the chamber outlet surrounds the oval shape of the conduit outlet 636. Therefore, fluid flowing from the outlet 624 is angled toward the slurry flowing through the conduit outlet 636 to control the perimeter of the resulting spray flowing through the conduit outlet 636.

During operation of the spray device 610 of this embodiment, a first fluid such as air, nitrogen, argon or the like is pumped into the chamber inlet 616 by a pump (not shown) while a second fluid, such as alcohol or water, contains ceramic particles therein to form a slurry that is pumped by a pump (not shown) through the conduit 626. The first fluid flows through the sections of the hollow chamber 614 and is angled by the third chamber section 618 toward the slurry that flows through the conduit outlet 636. When the first fluid and slurry are discharged from the spray device 610, the fluid and slurry mix to form two-phase droplets. As a result of the angled shape of the chamber outlet 624 and the angled shape of the conduit outlet 636 the first fluid directs the droplets to provide an oval-shaped spray of the second fluid causing a solid oval-shaped spray pattern at the surface of a component. As the droplets flow toward the surface of a component the liquid in the droplets evaporates leaving only the ceramic particles to provide a uniform coat at the surface of the component. The spray device 610 of this embodiment is referred to as a fan nozzle design and the spray device provides a flat spray (as compared to the conical sprays of FIGS. 3-5) that widens the spray area that is coated. Distribution of the spray at the surface has an extended central peak.

Figure 17:
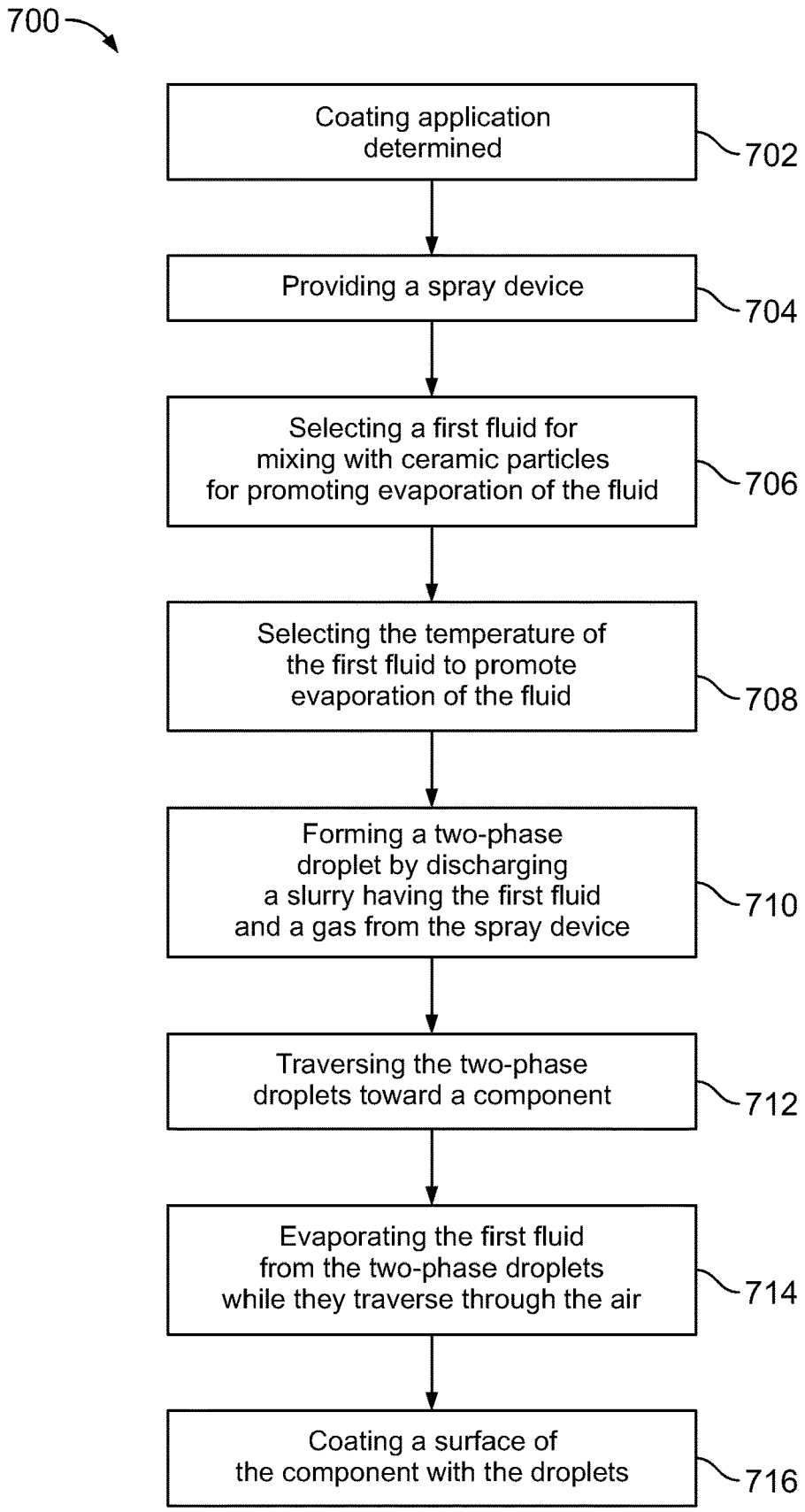
FIG. 17 is a flow chart of a method of coating a surface utilizing an atomizing spray device.

FIG. 17 illustrates a flow chart of one embodiment of a method 700 for coating a component with a spray device. According to the method of coating a component, at 702, a coating application where a component needs to be coated is determined to be presented. An atomizing spray device is provided at 704. At 706, a fluid for mixing with ceramic particles to form a slurry is selected to promote evaporation of the fluid during the spraying process. At 708, the temperature of the fluid flowing through the spray device outlet is selected to promote evaporation of the fluid during the spraying process. At 710, the atomizing spray device forms two-phase droplets. The two-phase droplets of ceramic particles then traverse through the air toward the surface of the component at 712. At 714, while the two-phase droplets are in the air before impacting the surface of the component the selected fluid evaporates from the two-phase droplets. The droplets then coat the surface of the component at 716.

In a first example of the method, a turbine engine on the wing of an airplane has a thermal barrier coating that is to be restored. After selecting the atomizing spray device, alcohol is chosen as the fluid to be mixed with the ceramic particles to form the slurry, because alcohol is a fluid that promotes evaporation. In this example, the temperature of the fluid is not selected or increased to promote evaporation of the spray. After the spray device discharges the fluid as part of a slurry from the spray device, a droplet that includes the fluid is formed. As this droplet traverses through the air, the fluid evaporates substantially reducing the amount of fluid in the droplet before the droplet impacts the surface of the turbine to form the thermal barrier coating.

In a second example of the method when a fan blade requires a coating the atomizing spray device is chosen. Water is the fluid selected to be mixed with the ceramic particles to form the slurry and does not promote evaporation of the fluid. In this example the temperature of the two-phase droplets is increased compared the temperature of the two-phase droplets without auxiliary heating of the droplets. Auxiliary heating of the droplets can include, but is not limited to, increasing the temperature of the water flowing to the inlet of the spray device or increasing the temperature of the water within the spray device as a result of an additional heat source within the spray device, or the like. By increasing the temperature of the fluid, in this example water, above the ambient temperature, kinetic energy is increased in the droplets and the likelihood of evaporation of the water in the droplets is more likely. Thus, the selected temperature of the fluid promotes evaporation. In this embodiment, the amount of water that evaporates from the droplets substantially reduces the amount of water in the droplet upon impact compared to the amount of water discharged from the spray device.

In an additional example, again, when a turbine engine is to be restored the fluid selected for mixing with the ceramic particles is alcohol to promote evaporation. In this embodiment, the ambient temperature is 20° C. (68° F.) and the selected temperature requires the temperature of the fluid entering the spray device to be increased to 40° C. (104° F.) to promote evaporation of the alcohol once the droplets are sprayed. In this embodiment, because of the selection of the alcohol and the increase in the droplet temperature, again a substantial amount of the alcohol discharged from the spray device evaporates prior to the droplets impacting the surface of the turbine engine.

In yet another example, a turbine engine is to be restored and the fluid selected for mixing with the ceramic particles is alcohol to promote evaporation. In this embodiment, the ambient temperature again is 20° C. (68° F.). In this example, the selected temperature is in a range between 25° C. (77° F.) and 78° C. (173° F.) or in a range below the boiling point of the alcohol to prevent evaporation within the spray device. After the discharge of the slurry and gas from the spray device and after the forming of the droplets, all of the alcohol in the droplets evaporates such that when the droplets impact the turbine engine no alcohol remains as part of the coating.

In one embodiment, a system is provided. The system has a fluid reservoir containing a fluid that promotes evaporation when the fluid is exposed to gas and a spray device having one or more hollow chambers having one or more conduits disposed therethrough that are fluidly connected to the first reservoir to receive a slurry containing the fluid and a mix of ceramic particles and the gas. Said one or more conduits extend from a conduit inlet to a conduit outlet where the slurry is discharged to form droplets containing the fluid such that, based on a discharged amount of fluid in the droplets, the fluid promotes evaporation when the fluid is exposed to a gas, as the droplets traverse from the spray device toward an article. In one embodiment, the fluid contained in the droplets at least partially evaporates prior to impacting the surface of the article being coated. In one embodiment, a secondary coating is discharged from the conduit outlet to provide at least one of, removal of loose particles from the article, removal of overspray from cooling holes, or coating thickness control.

In one embodiment, a method is contemplated to provide a coating to a component. That method includes providing a spray device and supplying a slurry of a fluid and ceramic particles to the spray device. The slurry is then discharged from the spray device to form droplets containing the fluid to impact the component. As the droplets traverse from the spray device towards the component the fluid contained in the droplets evaporates prior to impacting the component.

In one embodiment of the method the fluid is selected to promote evaporation of the fluid prior to impacting the component. In this embodiment, the fluid can be alcohol. In this embodiment, the fluid can also be a fluid that has a lower boiling point than water provided at the same atmospheric pressure as the fluid.

In another embodiment, the temperature of the slurry is increased to promote evaporation of the fluid prior to impacting the component. In this embodiment, the temperature of the slurry can be increased by at least 10° C. to promote evaporation of the fluid prior to impacting the component.

In one embodiment, all of the fluid contained in the droplets formed evaporate such that when the droplets impact the component the fluid is eliminated from the droplets. In another embodiment, more than 50% of the fluid by weight of the fluid discharged by the spray device evaporates prior to impacting the component.

In one embodiment, the method further comprises supplying a gas to the spray device and discharging the gas from the spray device. The gas is directed toward the slurry discharged from the spray device to mix with the slurry to form the droplets.

In one embodiment, the gas is selected from a group consisting of air, nitrogen, and argon. In an embodiment, the method further comprises selecting the gas to promote the evaporation of the fluid in the droplets prior to impacting the component.

In one embodiment, the droplets that impact the component form a thermal barrier coating on the component. In another embodiment, the component is a gas turbine.

In one embodiment the spray device comprises a housing and a hollow chamber disposed through the housing from a chamber inlet to a chamber outlet. The hollow chamber has a conical shape adjacent the chamber outlet that tapers inwardly toward a center axis of the hollow chamber and toward the chamber outlet such that a gas flowing through the hollow chamber is directed toward the center axis of the hollow chamber upon being discharged from the chamber outlet.

In this embodiment, the spray device further comprises a conduit disposed through and centrally located within the hollow chamber from a conduit inlet to a conduit outlet and receiving the slurry. In particular, the slurry is discharged at the conduit outlet along the center axis of the hollow chamber such that the gas flowing through the chamber outlet that is directed toward the center axis of the hollow chamber combines with the slurry to form the droplets. The gas shapes a plurality of the droplets as the droplets are formed to provide a uniform distribution of droplets on the component. In addition, a curvature of an outer wall of the hollow chamber that forms the conical shape determines the angle at which the gas discharges from the chamber outlet.

In one embodiment, the spray device comprises a housing and a hollow chamber disposed through the housing from a chamber inlet to a chamber outlet. The hollow chamber has a conical shape adjacent the chamber outlet that tapers outwardly away from a center axis of the hollow chamber and toward the chamber outlet such that a gas flowing through the hollow chamber is directed away from the center axis of the hollow chamber upon being discharged from the chamber outlet.

In this embodiment, the spray device can further comprise a conduit disposed through and centrally located within the hollow chamber from a conduit inlet to a conduit outlet and receiving the slurry. The conduit has a conical shape adjacent the conduit outlet that tapers outwardly away from the center axis of the hollow chamber and toward the conduit outlet such that the slurry flowing through the conduit is directed away from the center axis of the hollow chamber upon being discharged from the conduit outlet.

In this embodiment, the spray device further comprises one or more target surfaces disposed in the chamber outlet and secured to the conduit such that a center axis of the one or more target surfaces is off set from the center axis of the hollow chamber at the chamber outlet such that the one or more target surfaces direct slurry away from the center axis of the one or more target surfaces as the slurry is discharged from conduit outlet. As slurry is discharged at the conduit outlet away from the center axis of the one or more target surfaces, the gas flowing through the chamber outlet that is directed away from the center axis of the hollow chamber combines with the slurry to form the droplets. Thus, the gas shapes a plurality of the droplets as the droplets are formed to provide a uniform distribution of droplets on the component.

In another embodiment of this embodiment of the spray device, one or more target surfaces are disposed in the chamber outlet and secured to the conduit such that a center axis of the one or more target surfaces align with the center axis of the hollow chamber at the chamber outlet such that the one or more target surfaces direct slurry away from the center axis of the one or more target surfaces as the slurry is discharged from conduit outlet. As slurry is discharged at the conduit outlet away from the center axis of the one or more target surfaces, the gas flowing through the chamber outlet that is directed away from the center axis of the hollow chamber combines with the slurry to form the droplets. Thus, the gas shapes a plurality of the droplets as the droplets are formed to provide a uniform distribution of droplets on the component.

In one embodiment, at least one section of the hollow chamber is helically shaped, extending around the center axis of the hollow chamber to reduce shear forces of air flowing through the hollow chamber prior to the air being discharged from the chamber outlet. In another embodiment, at least one section of the conduit is helically shaped, extending around the center axis of the hollow chamber to reduce shear forces of slurry flowing through the conduit prior to being discharged from the chamber outlet.

In one embodiment, the spray device comprises a housing and a hollow chamber disposed through the housing from a chamber inlet to a chamber outlet and receiving a gas. The chamber outlet has an angled surface to elongate the chamber outlet along an axis perpendicular to the center axis of the hollow chamber at the outlet. In this embodiment, the spray device further comprises a conduit disposed through and centrally located within the hollow chamber from a conduit inlet to a conduit outlet and receiving the slurry. The conduit outlet also has an angled surface to elongate the conduit outlet along an axis perpendicular to the center axis of the hollow chamber at the outlet. The slurry is discharged at the conduit outlet such that the gas flowing through the chamber outlet is directed toward and combines with the slurry to form the droplets. Therefore, the gas shapes a plurality of the droplets as the droplets are formed to provide a uniform distribution of droplets on the component.

In one embodiment, a system is provided. The system includes a fluid reservoir containing a fluid that promotes evaporation when the fluid is exposed to air and a spray device having a hollow chamber that has a conduit disposed therethrough that is fluidly connected to the first reservoir to receive a slurry containing the fluid and a mix of ceramic particles. The fluid reservoir prevents evaporation from the fluid from being received within the conduit. The conduit extends from a conduit inlet to a conduit outlet where the slurry is discharged to form droplets containing the fluid such that based on a discharged amount of fluid in the droplets and the fluid promoting evaporation when the fluid is exposed to air, as the droplets traverse from the spray device towards the component the fluid contained in the droplets evaporates prior to impacting the component.

In one embodiment, the fluid is alcohol.

In one embodiment, the fluid contained in the droplets evaporates further based on slurry temperature at the chamber outlet. As the fluid flows through the spray device, the temperature of the fluid is increased to promote evaporation of the fluid as the fluid travels toward the component.

In one embodiment, the fluid reservoir increases the temperature of the fluid to promote evaporation of the fluid as the fluid travels toward the component. In another embodiment, the fluid reservoir has a fluid outlet located adjacent a bottom of the fluid reservoir to prevent evaporation from the fluid from being received within the conduit.

In this embodiment the system further comprises a gas reservoir containing a gas and fluidly connected to a chamber inlet of the hollow chamber such that the hollow chamber receives the gas. The gas flows through the spray device from the chamber inlet to a chamber outlet. The gas is discharged from the spray device at the chamber outlet to mix with the slurry discharged from the conduit outlet to form the droplets.

In one embodiment, the gas mixes with the slurry inside the conduit before being discharged from the spray device at the chamber outlet. In another embodiment, the gas includes at least one of air, nitrogen, or argon.

In one embodiment, a spray device is provided. The spray device has a housing and one or more hollow chambers disposed through the housing from one or more chamber inlets to one or more chamber outlets. The one or more hollow chambers are configured to direct gas received into the one or more hollow chambers away from the center axis of the hollow chamber upon being discharged from the chamber outlet. A conduit is disposed through and centrally located within the hollow chamber from a conduit inlet to a conduit outlet and receiving a slurry. The one or more hollow chambers are also configured to direct gas received into the one or more hollow chambers away from the center axis of the hollow chamber upon being discharged from the chamber outlet.

In one embodiment, the spray device further comprises one or more target surfaces disposed in the chamber outlet and secured to the conduit such that one or more edges of the one or more target surfaces atomize the gas and slurry flowing past the one or more edges to provide a uniform coating of a slurry and gas droplet formed by the spray device onto an article. In the embodiment, the one or more target surfaces have a converging shape adjacent the chamber outlet that tapers outwardly away from a center axis of the hollow chamber and toward the chamber outlet.

In one embodiment, the one or more target surfaces are secured to the conduit such that one or more center axes of the one or more target surfaces are off set from the center axis of the hollow chamber at the chamber outlet. In another embodiment, the one or more target surfaces are secured to the conduit such that a center axis of the one or more target surfaces align with the center axis of the hollow chamber at the chamber outlet. In yet another embodiment, at least one section of the hollow chamber is helically shaped, extending around the center axis of the hollow chamber from the inlet to the outlet.

In one embodiment, a method is provided for applying a coating to an article. Steps include supplying a slurry comprising fluid and ceramic particles to a spray device and discharging the slurry from the spray device to form droplets containing the fluid and the ceramic particles that are directed toward the component. As the droplets traverse from the spray device toward the component the fluid contained in the droplets at least partially evaporates prior to the ceramic particles impacting the component. In another embodiment, the fluid at least partially evaporates prior to the ceramic particles impacting the component. In yet another embodiment, an additional step of increasing a temperature of the slurry prior to discharging the slurry from the spray device is provided.

In one embodiment, another spray device is provided. The spray device has a housing and a hollow chamber disposed through the housing from a chamber inlet to a chamber outlet. The hollow chamber has a conical shape adjacent the chamber outlet that tapers outwardly away from a center axis of the hollow chamber and toward the chamber outlet such that a gas flowing through the hollow chamber is directed away from the center axis of the hollow chamber upon being discharged from the chamber outlet. A conduit is disposed through and centrally located within the hollow chamber from a conduit inlet to a conduit outlet and receiving a slurry. The conduit has a conical shape adjacent the conduit outlet that tapers outwardly away from the center axis of the hollow chamber and toward the conduit outlet such that the slurry flowing through the conduit is directed away from the center axis of the hollow chamber upon being discharged from the conduit outlet. One or more target surfaces is disposed in the chamber outlet and secured to the conduit such that an edge of the one or more target surfaces atomize the gas and slurry flowing past the edge to provide a uniform coating of a slurry and gas droplet formed by the spray device onto a surface of a component.

In one embodiment of the spray device, the one or more target surfaces are secured to the conduit such that a center axis of the one or more target surfaces are off set from the center axis of the hollow chamber at the chamber outlet. In another embodiment, the one or more target surfaces are secured to the conduit such that a center axis of the one or more target surfaces align with the center axis of the hollow chamber at the chamber outlet.

In one embodiment, at least one section of the hollow chamber is helically shaped, extending around the center axis of the hollow chamber to increase a shear force at the edge of the one or more target surfaces to provide a finer atomization of slurry and gas flowing past the edge of the one or more target surfaces. In another embodiment, at least one section of the conduit is helically shaped, extending around the center axis of the hollow chamber to increase a shear force at the edge of the one or more target surfaces to provide a finer atomization of slurry and gas flowing past the edge of the one or more target surfaces.

In one embodiment a method of providing a coating to a component is provided and includes providing a spray device. Slurry comprising fluid and ceramic particles is supplied to the spray device. The slurry is discharged from the spray device to form droplets containing the fluid to impact the component. As the droplets traverse from the spray device towards the component the fluid contained in the droplets evaporates prior to strengthen adhesion of the droplets to the component compared to adhesion of the droplet to the component had the fluid in the droplets not evaporated. In addition, the evaporation of the fluid contained in the droplets results in a more uniform coating on the component as compared to a coating formed if the fluid had not evaporated from the droplets.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A method comprising:

supplying a slurry comprising fluid and ceramic particles to a spray device; and discharging the slurry from the spray device toward a component, the slurry discharged to form droplets containing the fluid and the ceramic particles, wherein, as the droplets traverse from the spray device toward the component, at least a portion of the fluid contained in the droplets evaporates prior to the ceramic particles impacting the component.

2. The method of claim 1, wherein the at least the portion of the fluid contained in the droplets evaporates prior to the ceramic particles impacting the component.

3. The method of claim 1, further comprising:

increasing a temperature of the slurry prior to discharging the slurry.

4. The method of claim 3, wherein the temperature of the slurry is increased by heating the fluid inside the spray device.

5. The method of claim 1, further comprising:

directing a gas and the slurry through the spray device; and mixing the slurry with the gas upon discharge of the slurry from an outlet of the spray device to form the droplets as multi-phase droplets.

6. The method of claim 5, wherein the gas and the slurry are separately directed through the spray device in separate conduits in the spray device.

7. The method of claim 5, wherein the gas and the slurry mix with each other inside one or more conduits inside the spray device.

8. The method of claim 5, wherein the multi-phase droplets that are formed are two-phase droplets.

9. The method of claim 1, wherein discharging the slurry from the spray device includes discharging the slurry around a pintle at an outlet of the spray device.

10. The method of claim 1, wherein the fluid is an alcohol.

11. A method comprising:

directing fluid and ceramic particles through one or more conduits in a spray device toward an outlet of the spray device;

directing a gas through the one or more conduits in the spray device toward the outlet of the spray device;

mixing the gas with the fluid and the ceramic particles to form droplets containing the fluid and the ceramic particles; and discharging the droplets from the spray device toward a component, wherein at least a portion of the fluid contained in the droplets evaporates prior to the ceramic particles contacting the component.

12. The method of claim 11, further comprising:

heating the fluid inside the spray device prior to discharging the fluid and the ceramic particles from the spray device.

13. The method of claim 11, wherein the gas is directed to the outlet of the spray device through a first conduit of the one or more conduits in the spray device and the fluid and the ceramic particles are separately directed to the outlet of the spray device through a separate, second conduit of the one or more conduits in the spray device such that the gas mixes with the fluid and the ceramic particles outside the spray device.

14. The method of claim 11, wherein the gas, the fluid, and the ceramic particles are directed through at least one common conduit of the one or more conduits such that the gas mixes with the fluid and the ceramic particles inside the spray device.

15. The method of claim 11, wherein discharging the droplets from the spray device includes discharging the gas, the fluid, and the ceramic particles around a pintle at the outlet of the spray device.

16. A method comprising:

directing fluid and ceramic particles through a first conduit in a spray device toward an outlet of the spray device;

separately directing a gas through a separate, second conduit in the spray device toward the outlet of the spray device;

mixing the gas with the fluid and the ceramic particles upon discharge from the outlet of the spray device to form multi-phase droplets containing the fluid and the ceramic particles; and directing the droplets from the spray device toward a component, wherein at least a portion of the fluid in the droplets evaporates prior to the ceramic particles in the droplets contacting the component.

17. The method of claim 16, further comprising:

heating the fluid inside the spray device prior to the fluid and the ceramic particles being discharged from the outlet of the spray device.

18. The method of claim 16, wherein mixing the gas with the fluid and the ceramic particles upon discharge from the outlet of the spray device includes discharging the gas, the fluid, and the ceramic particles around a pintle at the outlet of the spray device.

19. The method of claim 16, wherein the fluid is an alcohol.

20. The method of claim 16, wherein the gas is one or more of air, nitrogen, or argon.

* * * * *